US010363754B2

(12) United States Patent
Matsunaga

(10) Patent No.: US 10,363,754 B2
(45) Date of Patent: Jul. 30, 2019

(54) INKJET PRINTING MACHINE

(71) Applicant: RISO KAGAKU CORPORATION, Tokyo (JP)

(72) Inventor: Katsuhiko Matsunaga, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/707,156

(22) Filed: Sep. 18, 2017

(65) Prior Publication Data

US 2018/0086096 A1 Mar. 29, 2018

(30) Foreign Application Priority Data

Sep. 28, 2016 (JP) ..... 2016-189758

(51) Int. Cl.

*B41J 2/03* (2006.01)
*B41J 2/19* (2006.01)
*B41J 2/175* (2006.01)

(52) U.S. Cl.

CPC . *B41J 2/19* (2013.01); *B41J 2/03* (2013.01); *B41J 2/175* (2013.01); *B41J 2/17523* (2013.01); *B41J 2/17596* (2013.01); *B41J 2/17513* (2013.01); *B41J 2/17553* (2013.01); *B41J 2/17556* (2013.01)

(58) Field of Classification Search

CPC . B41J 2/19; B41J 2/175; B41J 2/17596; B41J 2/03; B41J 2/17523; B41J 2/17553; B41J 2/17513; B41J 2/17556

See application file for complete search history.

(56) References Cited

U.S. PATENT DOCUMENTS 7,824,023 B2 * 11/2010 Izawa ..... B41J 2/16523 347/17
8,272,713 B2 9/2012 Katoh et al.
8,366,224 B2 2/2013 Yokota et al.
8,919,917 B2 12/2014 Koike et al.
(Continued)

FOREIGN PATENT DOCUMENTS

EP 1892101 2/2008
EP 2050572 4/2009
(Continued)

OTHER PUBLICATIONS

Extended European Search Report for EP 17193133.0 dated Jan. 24, 2018.
U.S. Appl. No. 15/707,037, filed Sep. 18, 2017.

*Primary Examiner* — Julian D Huffman
*Assistant Examiner* — Michael T Konczal
(74) *Attorney, Agent, or Firm* — Greenblum & Bernstein, P.L.C.

(57) ABSTRACT

A controlling unit causes a valve and a pump to perform the following operations: (i) the controlling unit closes the valve and drives the pump in initial filling of an inkjet head with ink; (ii) the controlling unit stops the pump and opens the valve on or after a time point when a tip of ink within an ink route reaches a prescribed position, which is higher than that of the ink cartridge and on an inkjet head side viewed from a joining joint part; (iii) the controlling unit closes the valve after the ink within the ink route flows backward to move air in a direct route into the ink cartridge; and (iv) the controlling unit drives the pump to fill the inkjet head with ink.

3 Claims, 5 Drawing Sheets

(56) References Cited

U.S. PATENT DOCUMENTS

| | | | | |
|---|---|---|---|---|
| 2010/0283808 | A1 | 11/2010 | Terakado et al. | |
| 2011/0310139 | A1* | 12/2011 | Ito | B41J 2/1707 347/6 |
| 2018/0086095 | A1* | 3/2018 | Saito | B41J 2/19 |

FOREIGN PATENT DOCUMENTS

| | | | | |
|---|---|---|---|---|
| EP | 2050572 | A2 * | 4/2009 | B41J 2/175 |
| JP | 11-263023 | | 9/1999 | |
| JP | 2005-349668 | | 12/2005 | |

* cited by examiner

INKJET PRINTING MACHINE

CROSS REFERENCE TO RELATED APPLICATION

This application claims benefit of priority under 35 U.S.C. § 119 to Japanese Patent Application No. 2016-189758, filed on Sep. 28, 2016, the entire contents of which are incorporated by reference herein.

BACKGROUND OF THE INVENTION

1. Field of the Invention

The present invention relates to an inkjet printing machine that discharges ink from an inkjet head to perform printing.

2. Description of the Related Art

An inkjet printing machine performs initial filling of an inkjet head with ink before starting use of the inkjet head (See, for example, Patent Literature 1: Japanese Patent Application Laid-Open No. 2005-349668).

An inkjet printing machine is configured to perform the initial filling by feeding ink from an ink cartridge to an inkjet head using a pump. Such an inkjet printing machine has an ink route connecting the ink cartridge to the inkjet head, to which a branch route for the pump is connected.

The branch route branches off from the ink route at a branching point on the ink route, and joins the ink route at a joining point, which is on an inkjet head side (downstream side) viewed from the branching point. The pump is disposed on the branch route. The reason for this disposition is to avoid disposition of the pump on the ink route to generate an appropriate negative pressure on nozzles of the inkjet head by a water head difference between the inkjet head and the ink cartridge.

A valve is disposed on a direct route that is a route between the branching point and the joining point on the ink route. In the initial filling of the inkjet head with ink, the inkjet head, the ink route, and the branch route are not filled with ink at the beginning thereof. Then the valve on the direct route is closed, and the pump is driven. This prevents ink from going through the direct route and causes the ink to go through the branch route toward the inkjet head. The direct route is thus not filled with ink and has residual air.

Upon this, the inkjet printing machine with the above configuration performs an operation to exhaust the residual air in the direct route from the nozzles of the inkjet head in the initial filling of the inkjet head with ink. For this operation, a valve is disposed also in the vicinity of a downstream side viewed from the joining point (a downstream end of the direct route) on the ink route. Then, in the initial filling of the inkjet head with ink, the following operation is performed.

First, with the inkjet head, the ink route, and the branch route not filled with ink, the valve in the direct route (first valve) is closed, and the valve in the vicinity of the downstream side viewed from the joining point (second valve) is opened. Then the pump is driven. This supplies ink from the ink cartridge to the ink route, and the ink flows through the branch route toward the inkjet head.

When the ink fills a part of a route on the downstream side viewed from the second valve, the first valve is opened and the second valve is closed. At this point, air is in the direct route. By opening the first valve and closing the second valve, the ink flows into the direct route from the downstream side, and air moves from the upstream side of the direct route to the branch route. Then the first valve is closed, and the second valve is opened. This sends air from the branch route to the downstream side viewed from the joining point on the ink route. Multiple repeats of such an opening and closing operation of the valves send the air in the direct route to the downstream side viewed from the joining point on the ink route, and fill the direct route with ink. Then, with the first valve closed and the second valve opened, the driving of the pump is continued such that the inkjet head is filled with ink. At this point, the air in the direct route from the beginning is sent to the inkjet head with ink and exhausted from the nozzles.

However, even if the air in the direct route is sent to the inkjet head to be exhausted, some air remains at a horizontal part, a bent part, and the like, which are on the way of the ink route to the inkjet head. This can cause residual air bubbles in the ink route. Such residual air bubbles in the ink route are sent to the inkjet head, bringing poor discharge of ink.

SUMMARY OF THE INVENTION

The present invention is made in view of the above discussion. An object of the present invention is to provide an inkjet printing machine that reduces the residual air bubbles in the ink route in the initial filling of the inkjet head with ink.

To achieve the above-described object, according to a first aspect of the present invention, there is provided an inkjet printing machine comprising: an inkjet head; an ink cartridge that is disposed at a position lower than that of the inkjet head, and holds ink therein; an ink route that connects the ink cartridge to the inkjet head; a branch route with one end connected to a branching point on the ink route and the other end connected to a joining point on the ink route, the joining point being on an inkjet head side viewed from the branching point; a pump that is disposed on the branch route, and used to send ink from the ink cartridge to the inkjet head; a valve that is disposed on a direct route which is a route between the branching point and the joining point, and opens and closes a channel for a fluid within the direct route; and a controller that (i) closes the valve and drives the pump in initial filling of the inkjet head with ink, (ii) stops the pump and opens the valve on or after a time point when a tip of ink introduced into the ink route reaches a prescribed position on an inkjet head side viewed from the joining point, (iii) closes the valve after the ink in the ink route flows backward to move the air in the direct route into the ink cartridge, and (iv) drives the pump to fill the inkjet head with ink.

According to a second aspect of the present invention, there is provided the inkjet printing machine further comprising an adjuster that adjusts a difference in height between the ink cartridge and the prescribed position on the ink route.

According to a third aspect of the present invention, there is provided the inkjet printing machine further comprising an exhauster that exhausts air, which has been moved from the direct route into the ink cartridge, from the ink cartridge.

According to the first aspect of the present invention, in the initial filling of the inkjet head with ink, the controller closes the valve and drives the pump. On or after a time point when the tip of ink in the ink route reaches the prescribed position, the controller stops the pump and opens the valve. After the ink in the ink route flows backward to move the air in the direct route into the ink cartridge, the controller closes the valve and drives the pump to fill the inkjet head with ink. Moving the air in the direct route into the ink cartridge thus removes the air from the ink route. This eliminates the need of moving the air in the direct route to the inkjet head for exhaust. This prevents residual air bubbles due to the air remaining in the route between the joining point and the inkjet head. As a result, this reduces the residual air bubbles in the ink route in the initial filling of the inkjet head with ink.

According to the second aspect of the present invention, the adjuster adjusts the difference in height between the ink cartridge and the prescribed position on the ink route. This increases the flow speed of ink in backflow and easily moves the air in the direct route to the ink cartridge.

According to the third aspect of the present invention, the air moved from the direct route to the ink cartridge is exhausted from the ink cartridge. This prevents air bubbles from mixing with ink.

DESCRIPTION OF THE EMBODIMENTS

Figure 1:
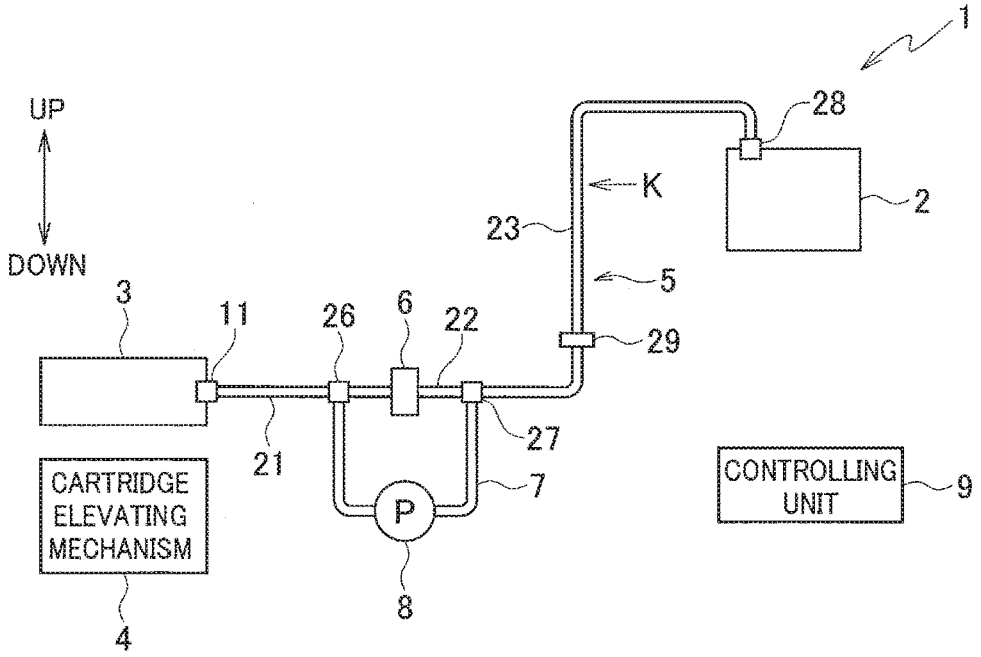
FIG. 1 is a diagram illustrating a configuration of an inkjet printing machine according to an exemplary embodiment of the present invention.

Exemplary embodiments of the present invention will be described below with reference to the accompanying drawings. In the drawings, the same or similar reference symbol is attached to the same or similar part or structural element.

The following embodiments present examples of an apparatus and the like for realizing the technical concept of the present invention. The technical concept of the present invention regarding the material, the shape, the structure, the arrangement, and the like of various structural components is not limited to these embodiments. Various modifications can be made in the technical concept of the present invention within the scope of claims.

Figure 2:
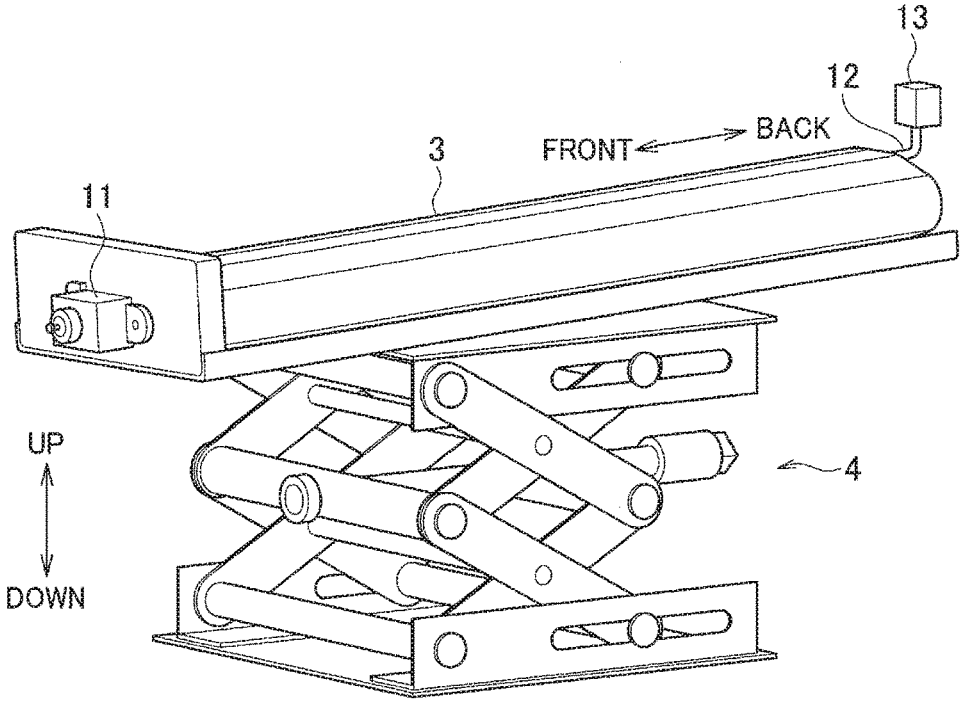
FIG. 2 is a perspective view of an ink cartridge and cartridge elevating mechanism of the inkjet printing machine shown in FIG. 1.

FIG. 1 is a diagram illustrating a configuration of an inkjet printing machine according to an exemplary embodiment of the present invention. FIG. 2 is a perspective view of an ink cartridge and cartridge elevating mechanism of the inkjet printing machine shown in FIG. 1.

As shown in FIG. 1, an inkjet printing machine 1 includes an inkjet head 2, an ink cartridge 3, cartridge elevating mechanism 4, an ink route 5, a valve 6, a branch route 7, a pump 8, and a controlling unit 9.

The inkjet head 2 includes a plurality of ink chambers (not shown) to store ink therein, and a plurality of nozzles (not shown) which communicate with respective ink chambers. Printing of an image is performed by discharging ink drops from the nozzles on a printing medium.

The ink cartridge 3 holds ink to be supplied to the inkjet head 2. The ink cartridge 3 is disposed at a position lower than that of the inkjet head 2. The ink cartridge 3 is connected by a cartridge joint part 11 to an upstream end of a cartridge-side route 21 of the ink route 5, which will be described later. In the ink route 5, an ink cartridge 3 side is an upstream side, and an inkjet head 2 side is a downstream side.

As shown in FIG. 2, the ink cartridge 3 is installed on the cartridge elevating mechanism 4 such that a back end side of the ink cartridge 3 is higher than a front end side of the ink cartridge 3, where a front end of the ink cartridge 3 is connected to the cartridge joint part 11. A back end of the ink cartridge 3 has its upper part connected to an atmosphere open valve 13 through an atmosphere open route 12. When the atmosphere open valve 13 is opened, the ink cartridge 3 is open to the atmosphere.

The cartridge elevating mechanism 4 elevates the ink cartridge 3.

The ink route 5 connects the ink cartridge 3 to the inkjet head 2. The ink route 5 includes the cartridge-side route 21, a direct route 22, and a head-side route 23. The cartridge-side route 21, the direct route 22, and the head-side route 23 are composed of tubes.

The cartridge-side route 21 is a route between the ink cartridge 3 and a branching point where the branch route 7 branches off from the ink route 5. The upstream end of the cartridge-side route 21 is connected through the cartridge joint part 11 to the ink cartridge 3. A downstream end of the cartridge-side route 21 is connected through a branching joint part 26 to an upstream end of the direct route 22 and an upstream end of the branch route 7. The branching joint part 26 is disposed at the branching point where the branch route 7 branches off from the ink route 5.

The direct route 22, which is a route on the ink route 5, is between the branching point where the branch route 7 branches off from the ink route 5, and a joining point where the branch route 7 joins the ink route 5 at a downstream side viewed from the branching point. The upstream end of the direct route 22 is connected through the branching joint part 26 to the downstream end of the cartridge-side route 21 and the upstream end of the branch route 7. A downstream end of the direct route 22 is connected through a joining joint part 27 to an upstream end of the head-side route 23 and a downstream end of the branch route 7. The joining joint part 27 is disposed at the joining point where the branch route 7 joins the ink route 5.

The head-side route 23 is a route between the joining point where the branch route 7 joins the ink route 5, and the inkjet head 2. The upstream end of the head-side route 23 is connected through the joining joint part 27 to the downstream end of the direct route 22 and the downstream end of the branch route 7. A downstream end of the head-side route 23 is connected through a head joint part 28 to the inkjet head 2. On the head-side route 23, a filter 29, which removes a foreign matter from ink, is disposed. The head-side route 23 has a length greater than the sum of the cartridge-side route 21 and the direct route 22.

The valve 6 is disposed on the direct route 22 to open and close a channel for a fluid (ink, air) within the direct route 22.

The branch route 7 is a route for installation of the pump 8. The branch route 7 is composed of a tube. One end (upstream end) of the branch route 7 is connected through the branching joint part 26 to the downstream end of the cartridge-side route 21 and the upstream end of the direct route 22 on the ink route 5. The other end (downstream end) of the branch route 7 is connected through the joining joint part 27 to the downstream end of the direct route 22 and the upstream end of the head-side route 23 on the ink route 5.

The pump 8 is used to feed ink from the ink cartridge 3 to the inkjet head 2. The pump 8 is disposed on the branch route 7. The pump 8 is composed of a tube pump.

The provision of the branch route 7 and the installation of the pump 8 on the branch route 7 are to avoid disposition of the pump 8 on the ink route 5 to generate an appropriate negative pressure on the nozzles of the inkjet head 2 by a water head difference between the inkjet head 2 and the ink cartridge 3.

The controlling unit 9 controls operations of the whole of the inkjet printing machine 1. The controlling unit 9 includes CPU (processor), RAM, ROM, a hard disk, and the like.

In initial filling of the inkjet head 2 with ink, the controlling unit 9 closes the valve 6 and drives the pump 8. When the tip of ink introduced in the ink route 5 reaches a prescribed position K, which is on an inkjet head 2 side viewed from the joining joint part 27, the controlling unit 9 stops the pump 8 and opens the valve 6. After the ink in the ink route 5 flows backward to move the air in the direct route 22 into the ink cartridge 3, the controlling unit 9 closes the valve 6 and drives the pump 8 to fill the inkjet head 2 with ink.

Operations by the inkjet printing machine 1 in the initial filling of the inkjet head 2 with ink will be described below with reference to a flowchart in FIG. 3.

Figure 3:
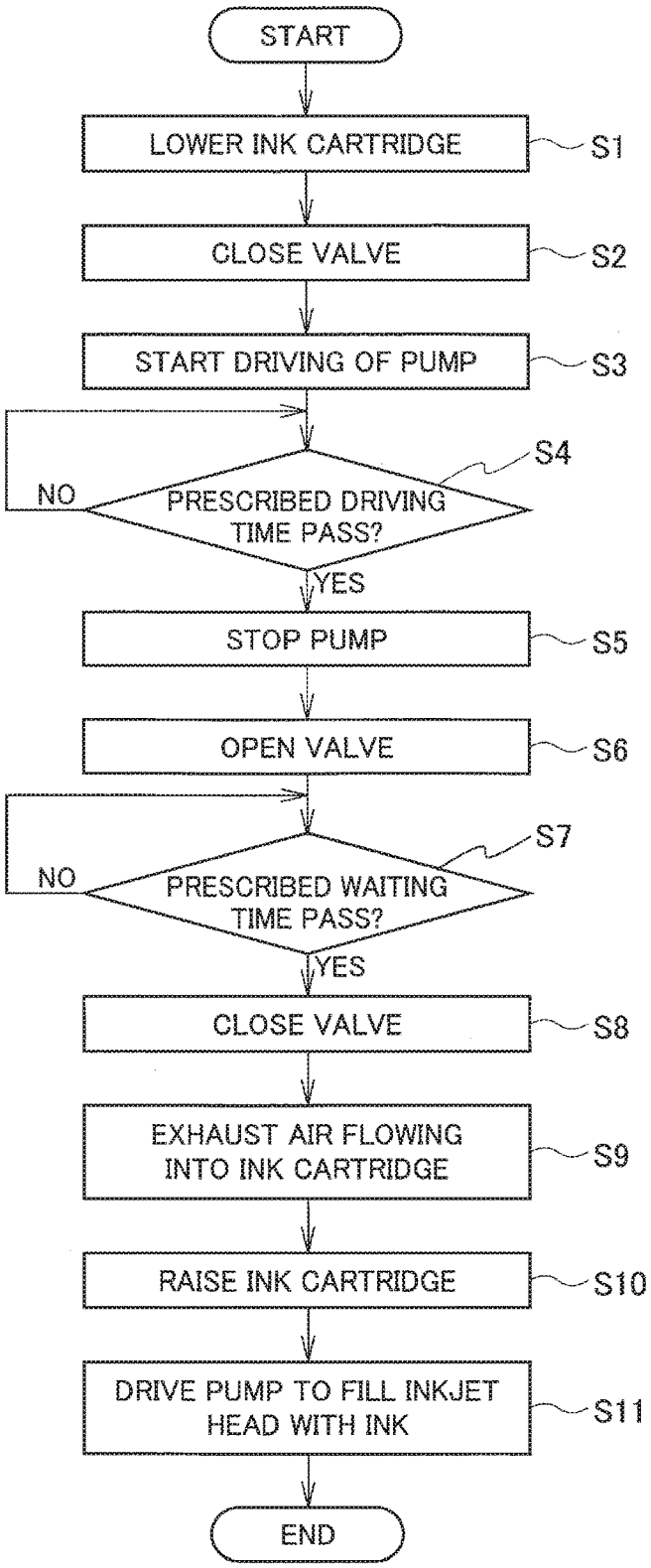
FIG. 3 is a flowchart for explaining operations in initial filling of an inkjet head with ink according to the exemplary embodiment of the present invention.

At step S1 in FIG. 3, the controlling unit 9 controls the cartridge elevating mechanism 4 to lower the ink cartridge 3 from a standard position to an initial filling position.

The standard position of the ink cartridge 3 is set as a position of the ink cartridge 3 in printing. The standard position is set to have a height such that a negative pressure generated on the nozzles of the inkjet head 2 by the water head difference between the inkjet head 2 and the ink cartridge 3 is to be appropriate. The initial filling position of the ink cartridge 3 is set as a position of the ink cartridge 3 in the initial filling of the inkjet head 2 with ink, and is lower than the standard position.

At step S2, the controlling unit 9 closes the valve 6.

At step S3, the controlling unit 9 starts driving of the pump 8. This enables ink to flow from the ink cartridge 3 into the cartridge-side route 21. As the valve 6 is closed, the ink flows from the cartridge-side route 21 to the head-side route 23 through the branch route 7.

At step S4, the controlling unit 9 determines whether or not a prescribed driving time passes since the driving of the pump 8 is started. The prescribed driving time is predetermined as a time from when the driving of the pump 8 is started until when the tip of the ink moving to the head-side route 23 through the branch route 7 reaches the prescribed position K on the ink route 5 (head-side route 23).

The prescribed position K is set such that a length La (see FIG. 4) of a route between the upstream end of the head-side route 23 and the prescribed position K is greater than a length Lb (see FIG. 4), which is the sum of the cartridge-side route 21 and the direct route 22. The prescribed position K is higher than the ink cartridge 3 at the initial filling position.

When the controlling unit 9 determines that the prescribed driving time does not pass since the driving of the pump 8 is started (step S4: NO), the controlling unit 9 repeats step S4. When the controlling unit 9 determines that the prescribed driving time passes since the driving of the pump 8 is started (step S4: YES), the controlling unit 9 stops the pump 8 at step S5.

Figure 4:
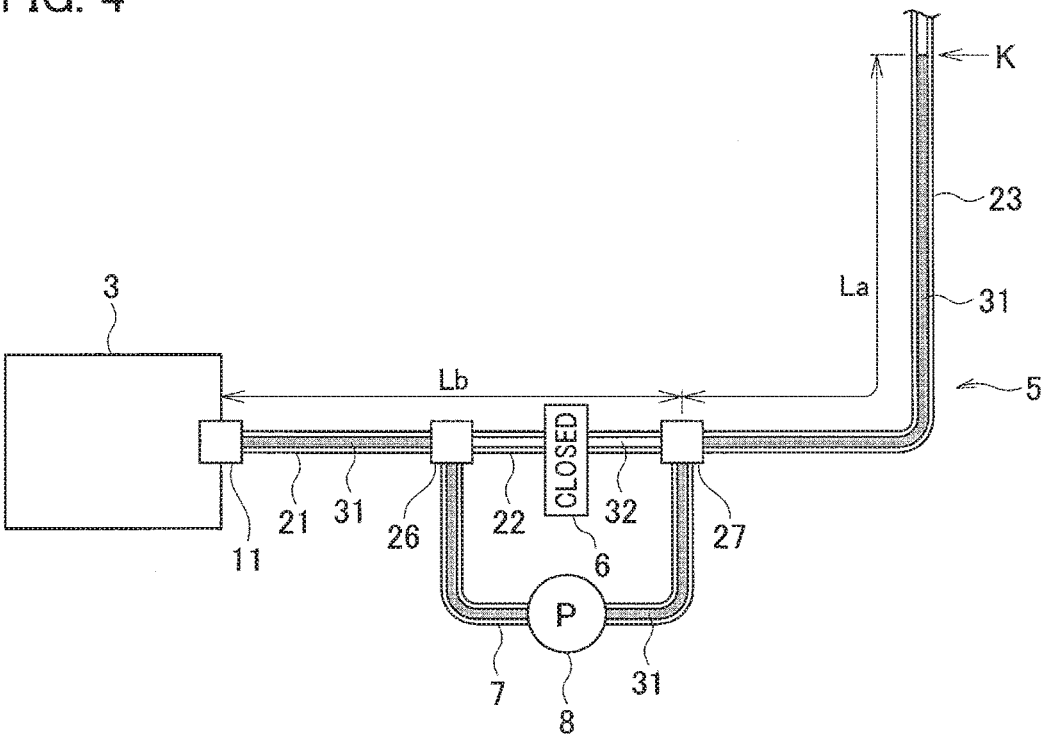
FIG. 4 is a diagram illustrating an operation in the initial filling of the inkjet head with ink according to the exemplary embodiment of the present invention.

When the pump 8 is stopped at step S5, as shown in FIG. 4, ink 31 fills the cartridge-side route 21, the branch route 7, and a route between the upstream end of the head-side route 23 and the prescribed position K. Air 32 is in the direct route 22.

Figure 5:
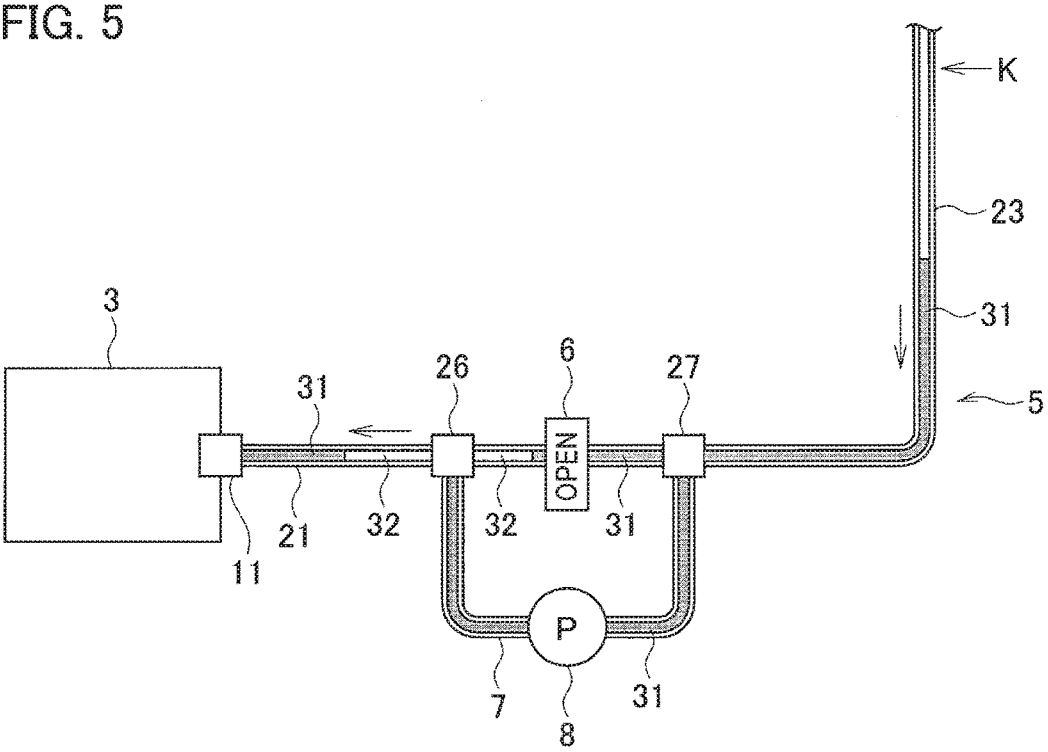
FIG. 5 is a diagram illustrating an operation in the initial filling of the inkjet head with ink according to the exemplary embodiment of the present invention.

Back to FIG. 3, at step S6, the controlling unit 9 opens the valve 6. When the valve 6 is opened, the water head difference between the ink cartridge 3 and the tip of the ink in the head-side route 23 brings inside of the ink route 5 under the negative pressure condition. As shown in FIG. 5, the ink 31 in the ink route 5 thus flows backward into the ink cartridge 3. This enables the air 32 in the direct route 22 to move toward the ink cartridge 3 with the ink 31. The air 32, which reaches the ink cartridge 3, flows into the ink cartridge 3.

At step S7, the controlling unit 9 determines whether or not a prescribed waiting time passes since the valve 6 is opened. The prescribed waiting time is predetermined as a time from when the valve 6 is opened until when flowing of the air 32 in the direct route 22 into the ink cartridge 3 ends. When the controlling unit 9 determines that the prescribed waiting time does not pass since the valve 6 is opened (step S7: NO), the controlling unit 9 repeats step S7.

When the controlling unit 9 determines that the prescribed waiting time passes since the valve 6 is opened (step S7: YES), at step S8 the controlling unit 9 closes the valve 6.

Figure 6:
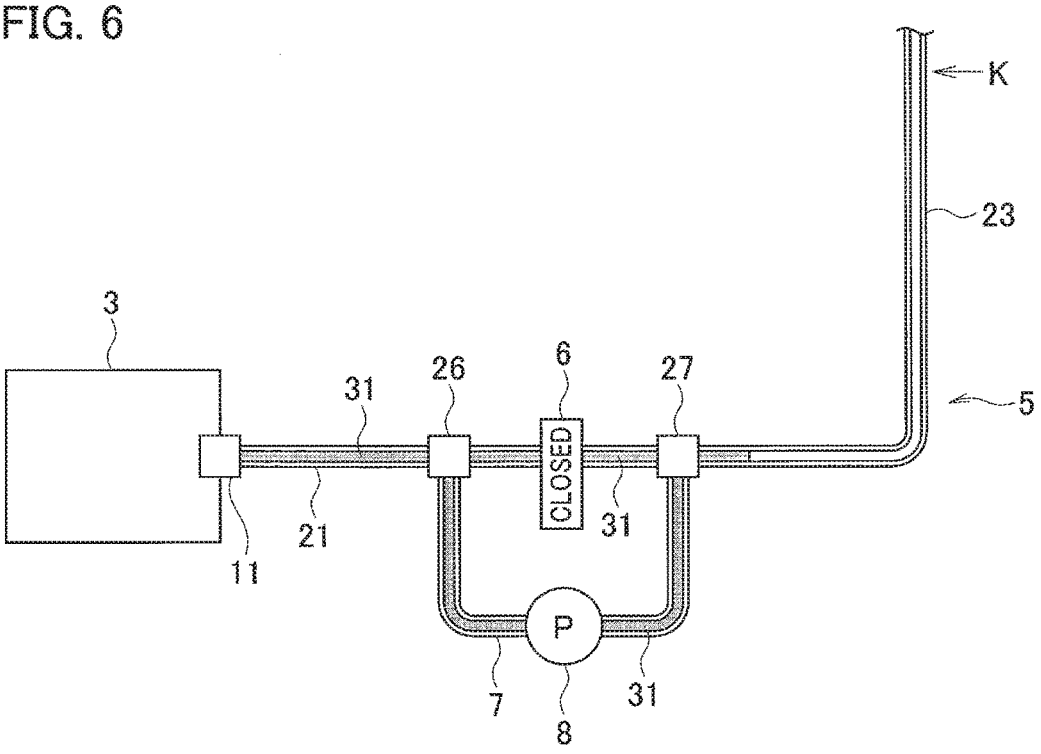
FIG. 6 is a diagram illustrating an operation in the initial filling of the inkjet head with ink according to the exemplary embodiment of the present invention.

At this point, the moving of the air 32 in the direct route 22 to the ink cartridge 3 is completed. As shown in FIG. 6, the ink 31 fills the ink route 5 from the upstream end of the cartridge-side route 21 to the downstream side viewed from the downstream end of the direct route 22. As described above, this is because the length La of the route between the upstream end of the head-side route 23 and the prescribed position K, is greater than the length Lb, which is the sum of the cartridge-side route 21 and the direct route 22. That is, when the moving of the air 32 in the direct route 22 into the ink cartridge 3 is completed, the ink 31 between the upstream end of the head-side route 23 and the prescribed position K from the beginning fills the ink route 5 from the upstream end of the cartridge-side route 21 to the downstream side viewed from the downstream end of the direct route 22.

Figure 7:
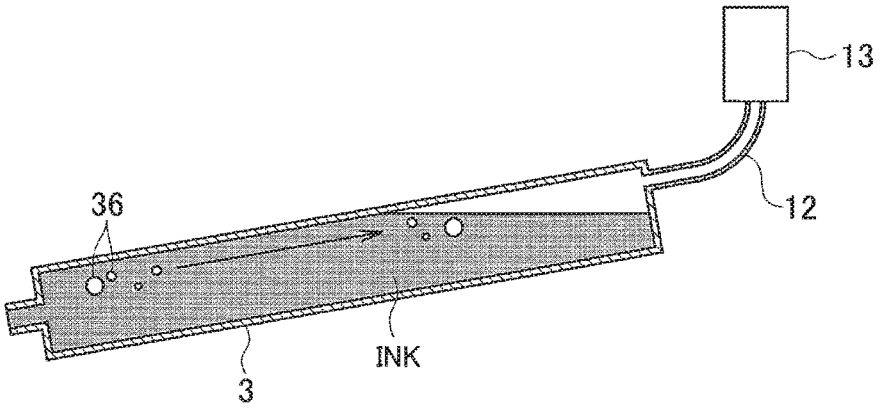
FIG. 7 is a diagram illustrating exhaust of air from the ink cartridge according to the exemplary embodiment of the present invention.

At step S9, the controlling unit 9 exhausts the air flowing into the ink cartridge 3. Specifically, the controlling unit 9 opens the atmosphere open valve 13 of the ink cartridge 3. As shown in FIG. 7, air bubbles 36 within the ink in the ink cartridge 3, which are due to the air 32 in the direct route 22 flowing into the ink cartridge 3, move backward to reach a liquid surface of the ink to disappear. Then air for the air bubbles 36 is exhausted through the atmosphere open valve 13 to outside. When a predetermined time passes since the atmosphere open valve 13 is opened, the controlling unit 9 closes the atmosphere open valve 13.

At step S10, the controlling unit 9 controls the cartridge elevating mechanism 4 to raise the ink cartridge 3 from the initial filling position to the standard position.

At step S11, the controlling unit 9 drives the pump 8 to fill the inkjet head 2 with ink. At this point, ink flows through the cartridge-side route 21, the branch route 7, and the head-side route 23, while the direct route 22 is already filled with ink and has no residual air. This enables the inkjet head 2, and the cartridge-side route 21, the direct route 22 and the head-side route 23 in the ink route 5 to be filled with ink and ends the initial filling.

When the initial filling of the inkjet head 2 with ink ends, the controlling unit 9 performs pressure cleaning. Specifically, with the valve 6 closed, the controlling unit 9 drives the pump 8 such that the flow speed of ink is faster than that in the above-described filling of the inkjet head 2 with ink. This enables ink to flow through the cartridge-side route 21, the branch route 7, and the head-side route 23 to be discharged from the nozzles of the inkjet head 2. At this point, when air bubbles are in the cartridge-side route 21 and the head-side route 23, the air bubbles are exhausted from the nozzles with ink. When a predetermined time passes since the driving of the pump 8 is started, the controlling unit 9 stops the pump 8. Then the controlling unit 9 makes wipers (not shown) wipe a nozzle surface of the inkjet head 2. This finishes the pressure cleaning.

As described above, in the inkjet printing machine 1, in the initial filling of the inkjet head 2 with ink, the controlling unit 9 closes the valve 6 and drives the pump 8. When the tip of the ink introduced in the ink route 5 reaches the prescribed position K, the controlling unit 9 stops the pump 8 and opens the valve 6. Then, after the ink in the ink route 5 flows backward to move the air 32 in the direct route 22 into the ink cartridge 3, the controlling unit 9 closes the valve 6 and drives the pump 8 to fill the inkjet head 2 with ink.

Figure 8:
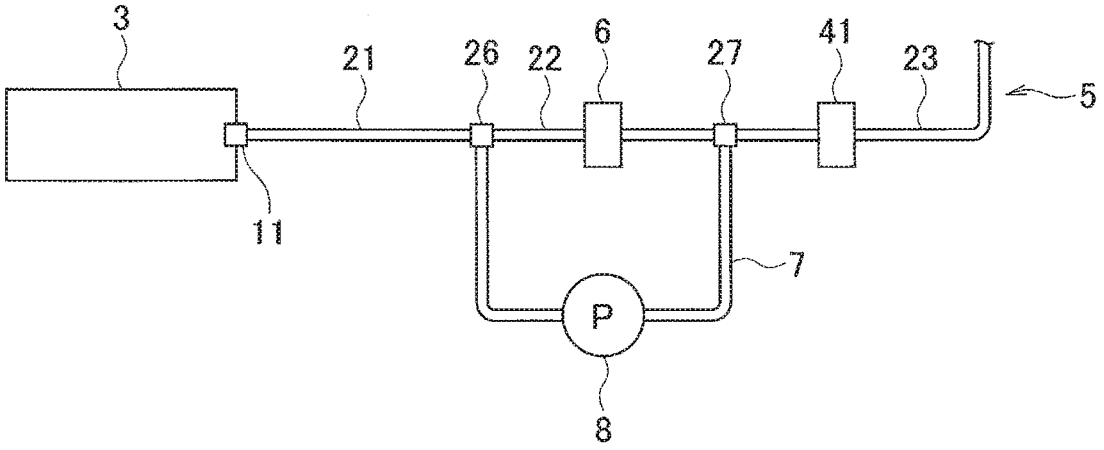
FIG. 8 is a diagram illustrating a configuration of major parts of a conventional inkjet printing machine, as an example.

In a conventional technique, air in the direct route 22 is sent to the inkjet head 2 and exhausted from the nozzles. In this case, as shown in FIG. 8, a valve 41 is disposed in the vicinity of the downstream side viewed from the joining joint part 27.

In the initial filling of the inkjet head 2 with ink, the inkjet head 2, the ink route 5, and the branch route 7 are not filled with ink. Under this situation, the valve 6 is closed and the valve 41 is opened. Then the pump 8 is driven. This supplies ink from the ink cartridge 3 to the ink route 5, and the ink flows toward the inkjet head 2 through the branch route 7.

When the ink fills a part of the head-side route 23, the valve 6 is opened and the valve 41 is closed. At this time, air remains in the direct route 22. By opening the valve 6 and closing the valve 41, the ink flows into the direct route 22 from the downstream side, and air moves from the upstream side of the direct route 22 to the branch route 7. Then the valve 6 is closed, and the valve 41 is opened. This sends air from the branch route 7 to the downstream side viewed from the joining joint part 27 on the ink route 5. Multiple repeats of such an opening and closing operation of the valves 6 and 41 send the air in the direct route 22 to the downstream side viewed from the joining joint part 27 on the ink route 5. Then with the valve 6 closed and the valve 41 opened, the driving of the pump 8 is continued to fill the inkjet head 2 with the ink. At this point, the air in the direct route 22 from the beginning is sent to the inkjet head 2 with the ink and exhausted from the nozzles.

In the conventional technique, when the air in the direct route 22 is sent to the inkjet head 2, some air remains at a horizontal part, a bent part, and the like on the way of the head-side route 23. This causes residual air bubbles in the head-side route 23. The head-side route 23 usually has a long length and includes a horizontal part and a bent part, which is likely to bring the residual air bubbles.

In the above-described conventional technique, when the air in the direct route 22 is exhausted from the inkjet head 2, ink is also discharged, which causes waste of ink. After the initial filling of the inkjet head 2 with ink, multiple times of pressurized cleaning is needed to exhaust the residual air bubbles in the ink route 5, which wastes a significant amount of ink.

On the other hand, in the present embodiment, moving the air 32 in the direct route 22 into the ink cartridge 3 using the backflow of ink removes the air 32 from the ink route 5, which eliminates the need of moving the air 23 in the direct route 22 to the inkjet head 2 for exhausting. This prevents residual air bubbles due to the air remaining in the head-side route 23. As a result, the inkjet printing machine 1 reduces the residual air bubbles in the ink route 5 in the initial filling of the inkjet head 2 with ink.

The inkjet printing machine 1 prevents the waste of ink due to the exhaust of air with ink from the inkjet head 2 as in the above-described conventional technique. The inkjet printing machine 1 reduces the residual air bubbles in the ink route 5 after the initial filling of the inkjet head 2 with ink, which reduces the number of times of the pressurized cleaning after the initial filling. This prevents the waste of ink still more.

The inkjet printing machine 1 adjusts the difference in height between the ink cartridge 3 and the prescribed position K on the ink route 5 by using the cartridge elevating mechanism 4. Specifically, in the initial filling of the inkjet head 2 with ink, the cartridge elevating mechanism 4 lowers the ink cartridge 3 from the standard position to the initial filling position. This makes the difference in height between the prescribed position K and the ink cartridge 3 greater, thereby increasing the flow speed of ink in backflow and easily moving the air in the direct route 22 into the ink cartridge 3.

The inkjet printing machine 1 includes the atmosphere open valve 13 to exhaust the air, which is moved from the direct route 22 to the ink cartridge 3, from the ink cartridge 3. This prevents the air bubbles from mixing with ink.

In the above-described embodiment, when the prescribed driving time passes since the driving of the pump 8 is started, that is when the tip of the ink reaches the prescribed position K, the pump is stopped. However, the stopping of the pump 8 may be on or after a time point when the tip of the ink reaches the prescribed position K.

The cartridge elevating mechanism 4 can be omitted when the prescribed position K on the ink route 5 is higher than that of the ink cartridge 3.

In the above-described embodiment, the atmosphere open valve 13 is disposed as exhausting means for exhausting the air, which flows into the ink cartridge 3 from the direct route 22, from the ink cartridge 3. The exhausting means is however not limited to the atmosphere open valve 13. For example, when ink is stored in a soft container (ink pack) in the ink cartridge, a pump can be connected to the container through a filter that passes a gas but not a liquid. Then, the air bubbles are exhausted from ink by driving the pump.

In the above-described embodiment, whether or not the moving of the air 32 in the direct route 22 into the ink cartridge 3 is completed is determined on the basis of the determination whether or not the prescribed waiting time passes since the valve 6 is opened. However, the method is not limited to this. For example, an air bubble sensor can be disposed on the cartridge-side route 21. On the basis of the result of detecting air bubbles by the air bubble sensor, it may be determined whether or not the moving of the air 32 in the direct route 22 into the ink cartridge 3 is completed.

The present invention is not limited to the above embodiments and the structural components can be realized by modifying them without departing from the gist at the implementation stage. Moreover, various inventions can be constituted by appropriately combining the various structural components disclosed in the above embodiment. For example, some of the structural components among all the structural components described in the embodiments may be omitted.

What is claimed is:

1. An inkjet printing machine comprising:

an inkjet head;

an ink cartridge that is disposed at a position lower than that of the inkjet head, and holds ink therein;

an ink route that connects the ink cartridge to the inkjet head;

a branch route with one end connected to a branching point on the ink route and the other end connected to a joining point on the ink route, the joining point being on an inkjet head side viewed from the branching point;

a pump that is disposed on the branch route, and used to send ink from the ink cartridge to the inkjet head;

a valve that is disposed on a direct route which is a route between the branching point and the joining point, and opens and closes a channel for a fluid within the direct route; and a controller configured (i) to close the valve and drive the pump in initial filling of the inkjet head with ink, (ii) to stop the pump and open the valve on or after a time point when a tip of ink introduced into the ink route reaches a prescribed position on an inkjet head side viewed from the joining point, (iii) to close the valve after the ink in the ink route flows backward to move the air in the direct route into the ink cartridge, and (iv) to drive the pump to fill the inkjet head with ink.

2. The inkjet printing machine according to claim 1, further comprising an adjuster that adjusts a difference in height between the ink cartridge and the prescribed position on the ink route.

3. The inkjet printing machine according to claim 1, further comprising an exhauster that exhausts air, which has been moved from the direct route into the ink cartridge, from the ink cartridge.

* * * * *